US011752514B2

(12) United States Patent
Cho

(10) Patent No.: US 11,752,514 B2
(45) Date of Patent: Sep. 12, 2023

(54) SPRING FOR PUMPING-TYPE CONTAINER AND PUMPING-TYPE CONTAINER INCLUDING SAME

(71) Applicant: TAESUNG INDUSTRIAL CO., LTD., Anyang-si (KR)

(72) Inventor: Min Jun Cho, Goyang-si (KR)

(73) Assignee: TAESUNG INDUSTRIAL CO., LTD., Anyang-si (KR)

( * ) Notice: Subject to any disclaimer, the term of this patent is extended or adjusted under 35 U.S.C. 154(b) by 0 days.

(21) Appl. No.: 17/890,259

(22) Filed: Aug. 17, 2022

(65) Prior Publication Data

US 2023/0144747 A1 May 11, 2023

(30) Foreign Application Priority Data

Nov. 10, 2021 (KR) ..... 10-2021-0153721

(51) Int. Cl.
*B05B 11/00* (2023.01)
*B05B 11/10* (2023.01)

(52) U.S. Cl.
CPC ..... *B05B 11/1077* (2023.01); *B05B 11/1025* (2023.01)

(58) Field of Classification Search
CPC ..... B05B 11/1077; B05B 11/1025
See application file for complete search history.

(56) References Cited

U.S. PATENT DOCUMENTS

2009/0102106 A1* 4/2009 Ohashi ..... F16F 1/3665 267/153
2016/0082456 A1* 3/2016 Tada ..... B05B 11/1077 222/321.9
2022/0184650 A1* 6/2022 Bartolucci ..... B05B 11/1052
2023/0144747 A1* 5/2023 Cho ..... B05B 11/1077 222/459

FOREIGN PATENT DOCUMENTS

EP 3854486 A1 * 7/2021 ..... B05B 11/3077
JP H10-73138 A 3/1998
KR 10-2017-0009350 A 1/2017
KR 10-2120009 B1 6/2020
KR 10-2123187 B1 6/2020
WO WO-2017010838 A1 * 1/2017 ..... B21F 35/00

* cited by examiner

*Primary Examiner* — Bob Zadeh
(74) *Attorney, Agent, or Firm* — Hauptman Ham, LLP

(57) ABSTRACT

The present disclosure relates to a spring for a pumping-type container having a first helical part and a second helical part, and a pumping-type container including the same, and has been made to solve a problem caused by independent elastic deformation of the first helical part and the second helical part.

4 Claims, 12 Drawing Sheets

SPRING FOR PUMPING-TYPE CONTAINER AND PUMPING-TYPE CONTAINER INCLUDING SAME

CROSS-REFERENCE TO RELATED APPLICATION(S)

This application is based upon and claims the benefit of priority from Korean Patent Application No. 10-2021-0153721, filed on Nov. 10, 2021 in the Korean Intellectual Property Office, the entire contents of which is incorporated herein by reference.

BACKGROUND

1. Field

The present disclosure relates to a pumping-type container having a structure for discharging liquid content stored in a container part thereof little by little through pumping by a button pressing operation.

2. Description of the Prior Art

A pumping-type container having a structure for discharging liquid content stored in a container part thereof through pumping by a button pressing operation has a spring for, when the button is pressed downward, accumulating an elastic force by which the button can ascend to the original position.

FIG. 10 is a view showing a conventional spring for a pumping-type container, and FIG. 11 is a view showing a pumping-type container in which the conventional spring for a pumping-type container is installed.

As illustrated in FIG. 10, a spring 180 for a pumping-type container includes an upper support plate 181 having a circular upper through-hole 181*a* extending therethrough, a lower support plate 182 disposed below the upper support plate 181, and a first helical part 183 and a second helical part 184 installed between the upper support plate 181 and the lower support plate 182 such that the upper ends thereof are fixed to the bottom surface of the upper support plate 181 and the lower ends thereof are fixed to the upper surface of the lower support plate 182.

The lower support plate 182 has a lower through-hole 182*a* extending through the center thereof.

The first helical part 183 has a left-hand helical shape.

The first helical part 183 has a helical trajectory of which the rotation angle is 720 degrees.

The first helical part 183 has no point connected to the second helical part 184 and includes a uniform cross-sectional area as a whole.

The second helical part 184 has a left-hand helical shape.

The second helical part 184 is configured such that the upper end of thereof is fixed to a point of the bottom surface of the upper support plate 181, which is linearly symmetric to a point to which the upper end of the first helical part 183 is fixed, with reference to the center line (see "C" of FIG. 4) of the upper through-hole 181*a*, and the lower end of thereof is fixed to a point of the upper surface of the lower support plate 182, which is linearly symmetric to a point to which the lower end of the first helical part 183 is fixed, with reference to the center line (see "C" of FIG. 4) of the lower through-hole 182*a*.

The second helical part 184 has a helical trajectory of which the rotation angle is 720 degrees.

The second helical part 184 includes a uniform cross-sectional area as a whole.

As illustrated in FIG. 11, the spring 180 for a pumping-type container is installed inside a container part 110 such that the upper support plate 181 is supported on a pressing member 170 and the lower support plate 182 is supported on a spring support member 150.

Hereinafter, the operation of the spring 180 for a pumping-type container will be described.

First, when the button 140 is pressed toward the container part 110, the pressing member 170 is descended and thus an elastic force is accumulated in the spring 180 for a pumping-type container.

Next, when the operation of pressing the button 140 is stopped, the button 140 is ascended by the elastic force accumulated in the spring 180 for a pumping-type container.

However, in the case of the conventional spring 180 for a pumping-type container, the first helical part 183 and the second helical part 184 are separated from each other. Therefore, there is a problem in that the first helical part 183 and the second helical part 184 are independently elastically deformed when the button 140 is pressed.

When the first helical part 183 and the second helical part 184 are independently elastically deformed, the degree of deformation of the first helical part 183 and the second helical part 184 in the direction of the plate surface of the upper support plate 181 increases when the button 140 is pressed. Therefore, the degree of deformation of the first helical part 183 and the second helical part 184 in a direction perpendicular to the plate surface of the upper support plate 181 decreases.

When the degree of deformation of the first helical part 183 and the second helical part 184 in the direction perpendicular to the plate surface of the upper support plate 181 decreases, the elastic force accumulated in the spring 180 for a pumping-type container is reduced. Therefore, the button 140 cannot stably ascend.

In addition, when the first helical part 183 and the second helical part 184 are independently elastically deformed, the variance in the magnitude and direction of the elastic force accumulated in the spring 180 increases.

When the variance in the magnitude and direction of the elastic force accumulated in the spring 180 increases, the button 140 should be pressed after an appropriate pressing position or pressing direction of the button 140 is selected. Therefore, the pressing operation of the button 140 becomes inconvenient.

SUMMARY OF THE INVENTION

Accordingly, it is an aspect of the present disclosure to provide a spring for a pumping-type container and a pumping-type container including the same, wherein a first helical part and a second helical part of the spring are elastically deformable in a mutually restricted state during a button pressing operation.

In accordance with an aspect of the present disclosure, a spring for a pumping-type container may include: an upper support plate having a circular upper through-hole extending therethrough; a lower support plate which has a circular lower through-hole and is disposed below the upper support plate such that the lower through-hole is aligned with the upper through-hole; a first helical part having a circular helical shape and installed between the upper support plate and the lower support plate such that the upper end thereof is fixed to the bottom surface of the upper support plate and the lower end thereof is fixed to the upper surface of the lower support plate; and a second helical part having a circular helical shape extending in a direction identical to that of the first helical part and installed between the upper support plate and the lower support plate such that the upper end thereof is fixed at a point of the bottom surface of the upper support plate, which is linearly symmetric to a point at which the upper end of the first helical part is fixed, with reference to the center line of the upper through-hole, and the lower end thereof is fixed at a point of the upper surface of the lower support plate, which is linearly symmetric to a point at which the lower end of the first helical part is fixed, with reference to the center line of the lower through-hole.

In addition, in order to increase an elastic force accumulated in the first helical part and the second helical part during a pressing operation of the button: in the first helical part, a section descending from the upper end thereof to the first helical lower-surface connection point and a section descending from the first helical upper-surface connection point to the lower end thereof may have cross-sectional areas larger than that of a section descending from the first helical lower-surface connection point to the first helical upper-surface connection point; and in the second helical part, a section descending from the upper end thereof to the second helical lower-surface connection point and a section descending from the second helical upper-surface connection point to the lower end thereof may have cross-sectional areas larger than that of a section descending from the second helical lower-surface connection point to the second helical upper-surface connection point.

According to the present disclosure, during a button pressing operation, a first helical part and a second helical part are elastically deformed in a mutually restricted state.

When the first helical part and the second helical part are elastically deformed in a mutually restricted state, the degree of deformation of the first helical part and the second helical part in the direction toward the plate surface of an upper support plate is reduced small. Therefore, it is possible to prevent a decrease in the degree of deformation of the first helical part and the second helical part in the direction perpendicular to the plate surface of the upper support plate during a button pressing operation.

When the degree of deformation of the first helical part and the second helical part in the direction perpendicular to the plate surface of the upper support plate is prevented from decreasing, it is possible to prevent the elastic force accumulated in the spring for a pumping-type container from decreasing. Therefore, the button can stably ascend.

In addition, when the first helical part and the second helical part are elastically deformed in a mutually restricted state, the variance in the magnitude and direction of the elastic force accumulated in the spring decreases.

When the variance in the magnitude and direction of the elastic force accumulated in the spring decreases, the range of selection of the button pressing position or pressing direction increases, thereby making the button pressing operation convenient.

BRIEF DESCRIPTION OF THE DRAWINGS

FIG. 9B is a view in which FIG. 9A is rotated clockwise by 90 degrees;

DETAILED DESCRIPTION OF THE EXEMPLARY EMBODIMENTS

Figure 1:
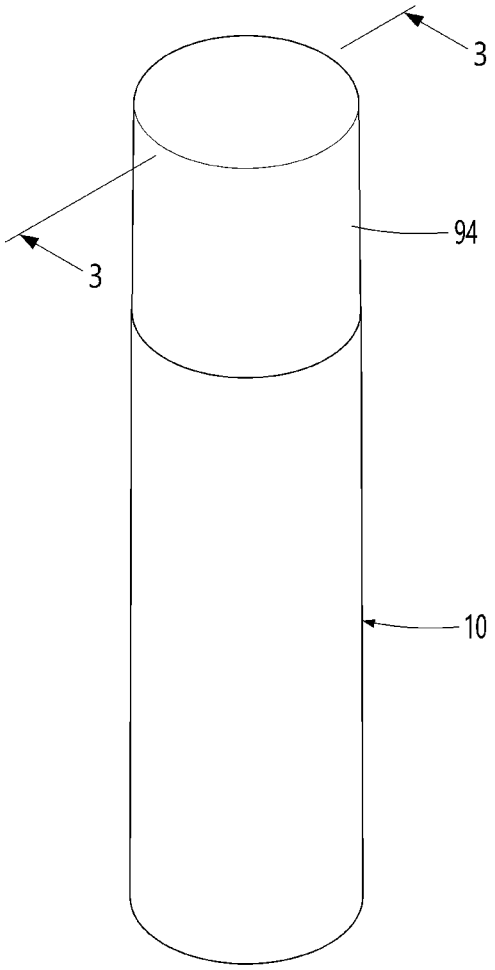
FIG. 1 is a combined perspective view of a cosmetic container according to an embodiment of the present disclosure.
Figure 2:
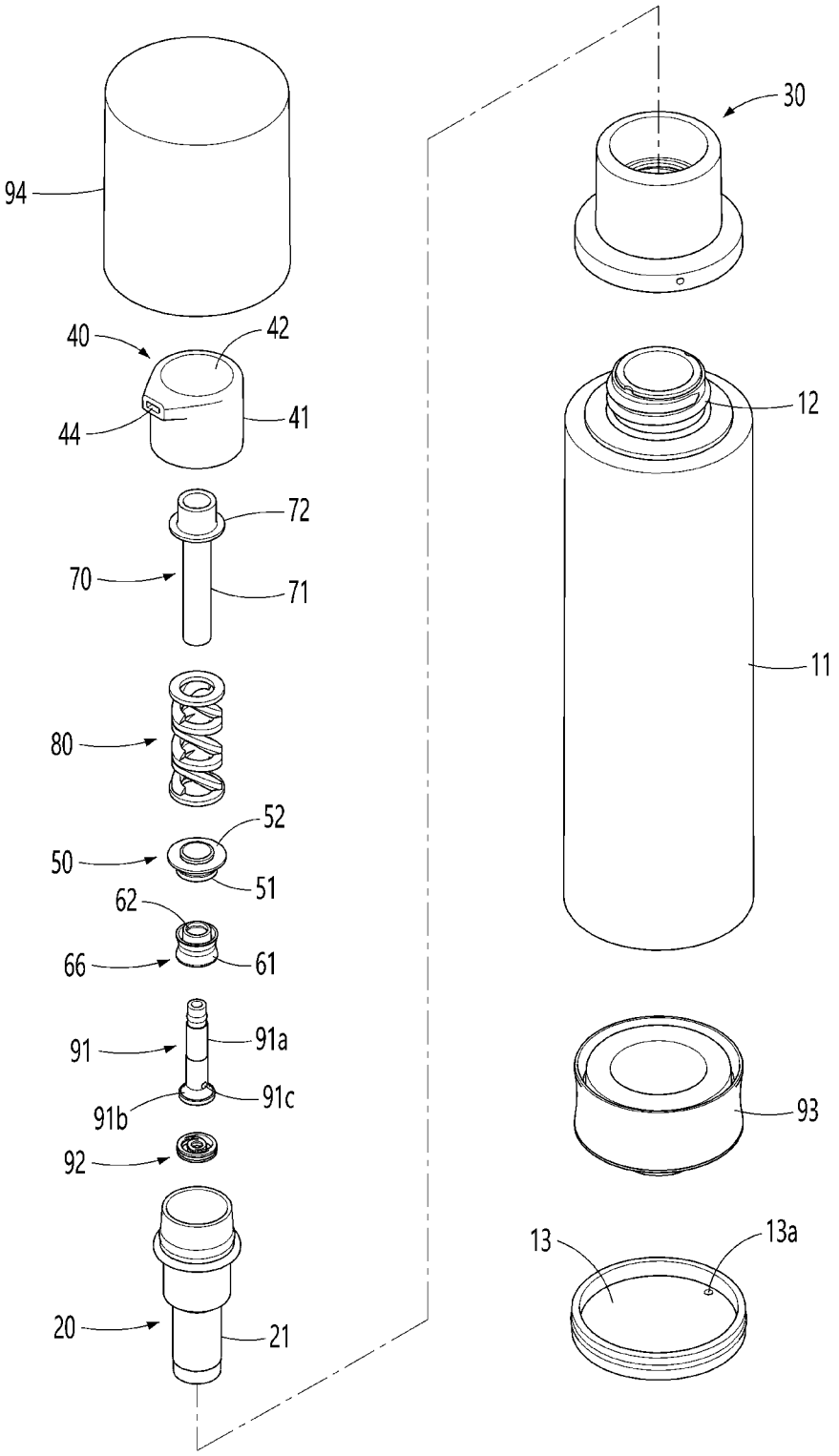
FIG. 2 is an exploded perspective view of a cosmetic container according to an embodiment of the present disclosure.
Figure 3:
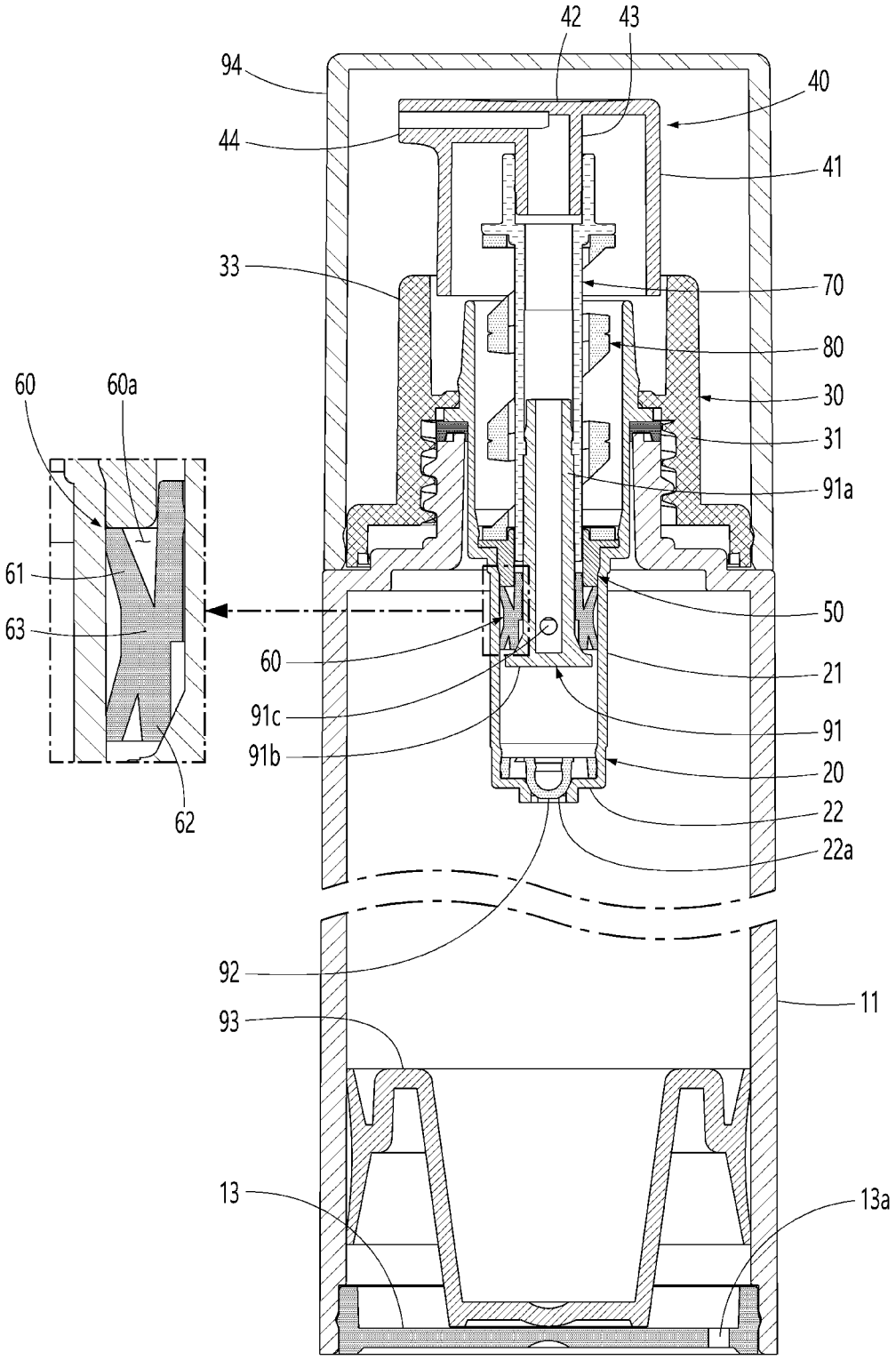
FIG. 3 is a cross-sectional view taken along line 3-3 of FIG. 1.

Hereinafter, the present disclosure will be described in detail with reference to the accompanying drawings.

A pumping-type container according to an embodiment of the present disclosure includes: a container part 10 including a container side part 11 having a straight tube shape, a container neck part 12 disposed on the upper end of the container side part 11, and a container bottom part 13 configured to seal the lower end opening of the container side part 11; a cylinder 20 installed inside the container part 10; an inner cap 30 coupled to the container neck part 12; a button 40 installed above the inner cap 30; a spring support member 50 coupled to the cylinder 20; a cylinder piston 60 installed inside the cylinder 20; a pressing member 70 coupled to the button 40; a spring 80 installed between the button 40 and the cylinder 20; an intermediate channel member 91 coupled to the pressing member 70; a cylinder valve 92 which is installed inside the cylinder 20 and has a function of a check valve; a container piston 93 installed inside the container part 10; and a container cap 94 installed to surround the button 40 and the inner cap 30.

The container bottom part 13 has an air ventilation hole 13*a* extending therethrough.

The cylinder 20 includes a cylinder side part 21 having a straight tube shape, and a cylinder bottom part 22 configured to seal the lower end of the cylinder side part 21.

The cylinder bottom part 22 has an inlet hole 22*a* extending through the center thereof.

The cylinder 20 is installed inside the container part 10 such that the cylinder bottom part 22 is disposed inside the container side part 11.

The inner cap 30 includes an inner cap side part 31 having a straight tube shape, and a button guide tube part 33 extending upward from the upper end of the inner cap side part 31.

The inner cap 30 is coupled to the container neck part 12 through the inner cap side part 31.

The button 40 includes a button side part 41 having a straight tube shape, a button ceiling part 42 configured to seal the upper end of the button side part 41, a vertical button channel part 43 which has a straight tube shape and is disposed on the bottom surface of the button ceiling part 42 so as to be side by side with the button side part 41, and a horizontal button channel part 44 which has a straight tube shape, is connected to the upper end of the vertical button channel part 43, and is disposed on the bottom surface of the button ceiling part 42 so as to be perpendicular to the button side part 41.

The button 40 is installed above the inner cap 30 so as to be able to ascend or descend along in the height direction of the container side part 11 along the button guide tube part 33.

The spring support member 50 includes a support member fastening part 51 having a straight tube shape, and a support-member support-protrusion 52 protruding from the upper end of the support member fastening part 51.

The spring support member 50 is coupled to the cylinder 20 through the support member fastening part 51 such that the support-member support-protrusion 52 is disposed above the cylinder 20.

The cylinder piston 60 includes a piston close-contact part 61 having a straight tube shape, a piston channel opening/closing part 62 which has a straight tube shape and is disposed inside the piston close-contact part 61 and side by side with the piston close-contact part 61, and a piston connection part 63 configured to connect the piston close-contact part 61 and the piston channel opening/closing part 62 and including a piston groove 60*a* having a concave shape disposed between the piston close-contact part 61 and the piston channel opening/closing part 62.

The cylinder piston 60 is installed inside the cylinder 20 such that the piston close-contact part 61 is in close contact with the inner surface of the cylinder side part 21.

The pressing member 70 includes a pressing part 71 having a straight tube shape, and a pressing member support protrusion 72 disposed on the outer surface of the pressing part 71 and protruding outward therefrom.

The pressing member 70 is coupled to the vertical button channel part 43 such that the upper end of the pressing part 71 is connected to the vertical button channel part 43, the pressing member support protrusion 72 is aligned with the support-member support-protrusion 52, and the lower end of the pressing part 71 is spaced apart from the cylinder piston 60.

The spring 80 for a pumping-type container includes an upper support plate 81 having a circular upper through-hole 81*a* extending therethrough, a lower support plate 82 disposed below the upper support plate 81, and a first helical part 83 and a second helical part 84 installed between the upper support plate 81 and the lower support plate 82 such that the upper end of each thereof is fixed to the bottom surface of the upper support plate 81, and the lower end of each thereof is fixed to the upper surface of the lower support plate 82.

The lower support plate 82 has a lower through-hole 82*a* extending therethrough.

The lower support plate 82 is disposed below the upper support plate 81 such that the lower through-hole 82*a* is aligned with the upper through-hole 81*a*.

The first helical part 83 has a left-hand helical shape.

The first helical part 83 has a helical trajectory, the rotation angle of which is (180+360×N) degrees (N is 2), that is, the rotation angle of the helical trajectory is 900 degrees.

The first helical part 83 is connected to the upper surface of the second helical part 84 through the bottom surface of points at which a rotation angle of the helical trajectory from the upper end thereof is (360×M−180) degrees (M is a positive integer ≤N, that is, M is 1 and 2), that is, the rotation angle of the helical trajectory is 180 and 540 degrees, and is connected to the bottom surface of the second helical part 84 through the upper surface of points at which a rotation angle of the helical trajectory is (360×M) degrees, that is, the rotation angle of the helical trajectory is 360 and 720 degrees.

Figure 5:
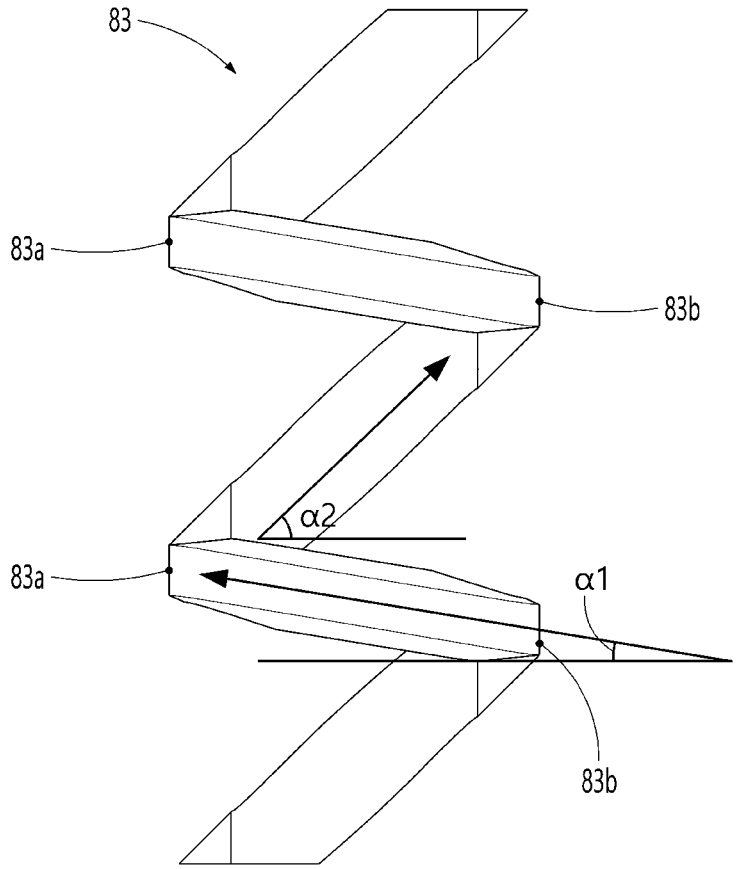
FIG. 5 is a view showing a first helical part according to an embodiment of the present disclosure.
Figure 6:
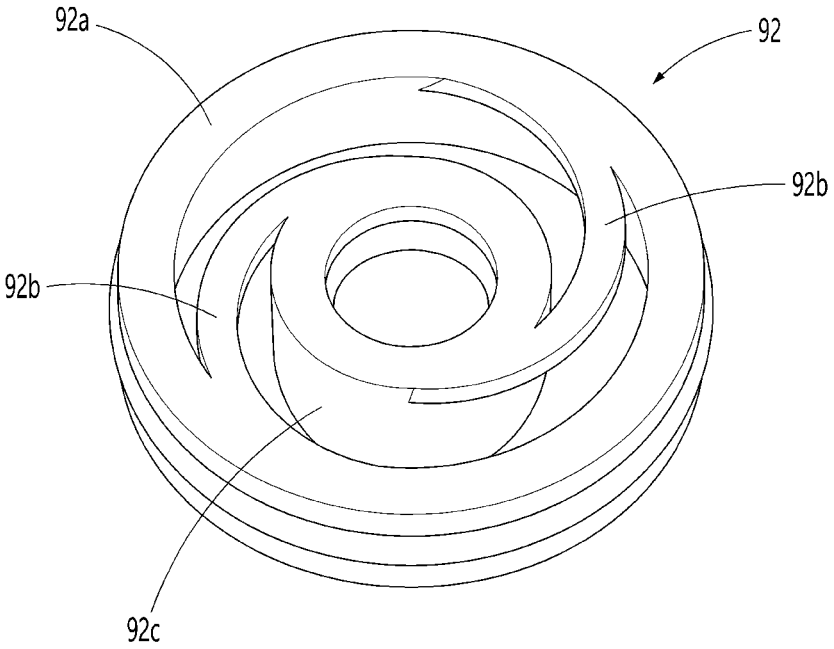
FIG. 6 is a view showing a cylinder valve according to an embodiment of the present disclosure.

In the first helical part 83, a section descending from a first helical lower-surface connection point 83*a* to a first helical upper-surface connection point 83*b* has a lead angle (α1 of FIG. 5) smaller than that (α2 of FIG. 5) of the other portion of the first helical part. The first helical lower-surface connection point 83*a* refers to a point connected to the upper surface of the second helical part 84 through the bottom surface of the first helical part 83, and the first helical upper-surface connection point 83*b* refers to a point connected to the bottom surface of the second helical part 84 through the upper surface of the first helical part 83.

The second helical part 84 has a left-hand helical shape.

Figure 4:
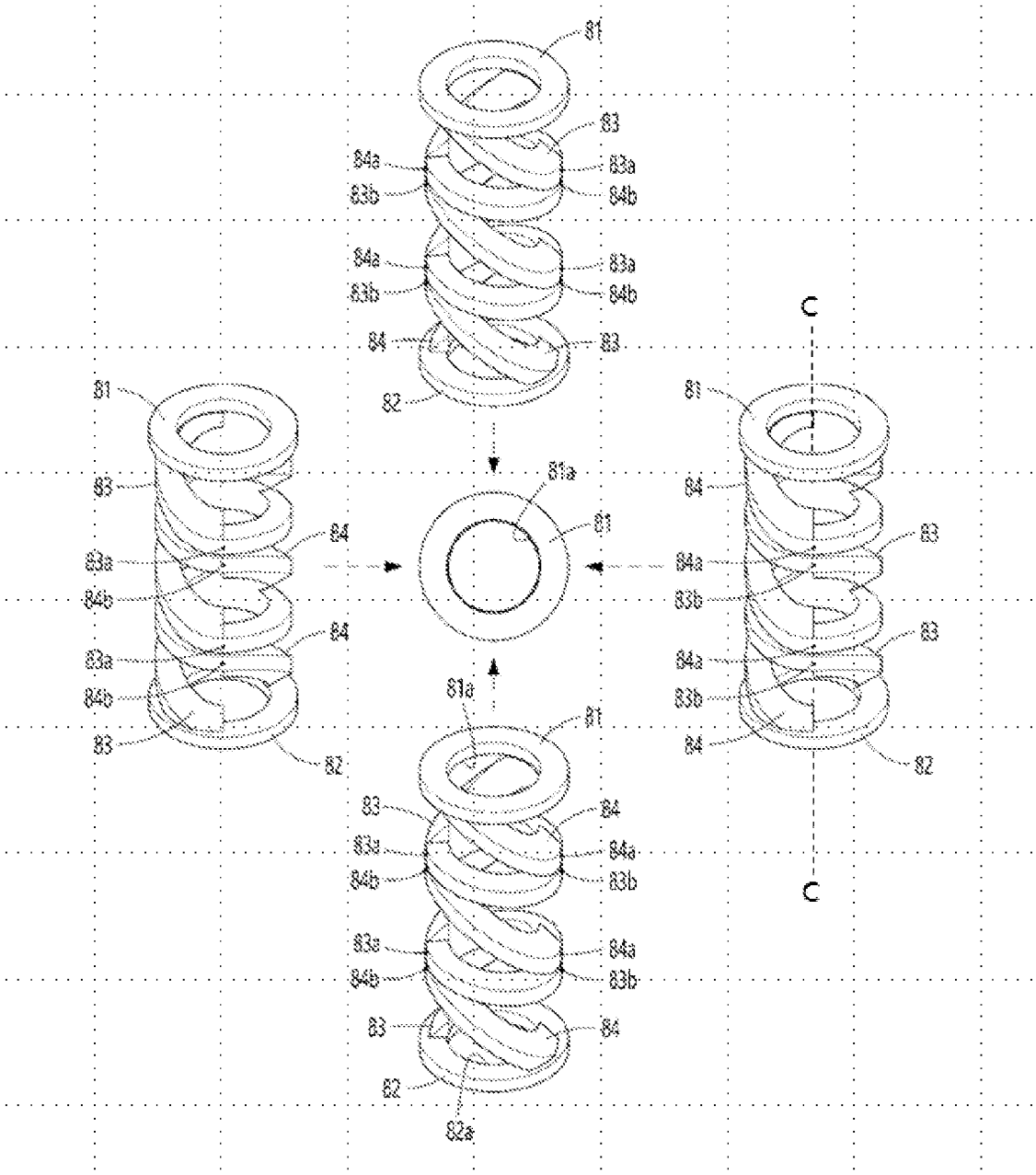
FIG. 4 is a view showing perspective views of a spring for a pumping-type container, which are respectively seen from the front, rear, left, and right thereof, together with a plan view thereof, according to an embodiment of the present disclosure.

The upper end of the second helical part 84 is fixed to a point of the bottom surface of the upper support plate 81, which is linearly symmetric to a point to which the upper end of the first helical part 83 is fixed, with reference to the center line (see "C" of FIG. 4) of the upper through-hole 81*a*. Further, the lower end of the second helical part 84 is fixed to a point of the upper surface of the lower support plate 82, which is linearly symmetric to a point to which the lower end of the first helical part 83 is fixed, with reference to the center line (see "C" of FIG. 4) of the lower through-hole 82*a*.

The second helical part 84 has a helical trajectory, the rotation angle of which is (180+360×2) degrees, that is, the rotation angle of the helical trajectory is 900 degrees.

The second helical part 84 is connected to the upper surface of the first helical part 83 through the bottom surface of points at which a rotation angle of the helical trajectory from the upper end thereof is (360×M−180) degrees, that is, the rotation angle of the helical trajectory is 180 and 540 degrees, and is connected to the bottom surface of the first helical part 83 through the upper surface of points at which a rotation angle of the helical trajectory from the upper end thereof is (360×M) degrees, that is, the rotation angle of the helical trajectory is 360 and 720 degrees.

In the second helical part 84, a section descending from a second helical lower-surface connection point 84*a* to a second helical upper-surface connection point 84*b* has a lead angle (see α1 of FIG. 5) smaller than that (see α2 of FIG. 5) of the other portion of the second helical part. The second helical lower-surface connection point 84*a* refers to a point connected to the upper surface of the first helical part 83 through the bottom surface of the second helical part 84, and the second helical upper-surface connection point 84*b* refers to a point connected to the bottom surface of the first helical part 83 through the upper surface of the second helical part 84.

In addition, in order to increase an elastic force accumulated in the first helical part 83 and the second helical part 84 during the pressing operation of the button 40, the first helical part 83 and the second helical part 84 are configured as follows.

That is, in the first helical part 83, a section descending from the upper end thereof to the first helical lower-surface connection point 83*a* and a section descending from the first helical upper-surface connection point 83*b* to the lower end thereof have cross-sectional areas larger than that of a section descending from the first helical lower-surface connection point 83*a* to the first helical upper-surface connection point 83*b*.

Further, in the second helical part 84, a section descending from the upper end thereof to the second helical lower-surface connection point 84*a* and a section descending from the second helical upper-surface connection point 84*b* to the lower end thereof have cross-sectional areas larger than that of a section descending from the second helical lower-surface connection point 84*a* to the second helical upper-surface connection point 84*b*.

The spring 80 is installed such that the upper support plate 81 is supported on the pressing member support protrusion 72, and the lower support plate 82 is supported on the support-member support-protrusion 52.

The spring 80 is made of polypropylene, thermoplastic copolyester elastomer, or the like.

The intermediate channel member 91 includes an intermediate discharge channel part 91*a* which has a straight tube shape having a sealed lower end, and an intermediate channel opening/closing part 91*b* which has a skirt shape and extends from the lower end of the intermediate discharge channel part 91*a*.

The intermediate discharge channel part 91*a* includes an intermediate discharge channel hole 91*c* extending therethrough.

The intermediate channel hole 91*c* connects the inner space of the cylinder 20 and the inner space of the intermediate discharge channel part 91*a* when the intermediate channel opening/closing part 91*b* is descended and thus separated from the piston channel opening/closing part 62.

The intermediate channel member 91 is coupled to the pressing part 71 such that the intermediate channel opening/closing part 91*b* is in contact with the lower end of the piston channel opening/closing part 62.

The cylinder valve 92 includes a tubular valve body part 92*a*, a valve support arm 92*b* disposed on the inner circumferential surface of the valve body part 92*a*, and a closing protruding part 92*c* which has a U-shaped cross-section shape and is connected to the valve support arm 92*b*.

The cylinder valve 92 is installed inside the cylinder 20 such that the closing protruding part 92*c* closes the inlet hole 22*a*.

Hereinafter, a method of using a pumping-type container having the above configuration according to an embodiment of the present disclosure will be described with reference to FIG. 7 and FIG. 8.

First, the button 40 is pressed and descended downward. An elastic force is accumulated in the spring 80 while the button 40 is descended.

Figure 7:
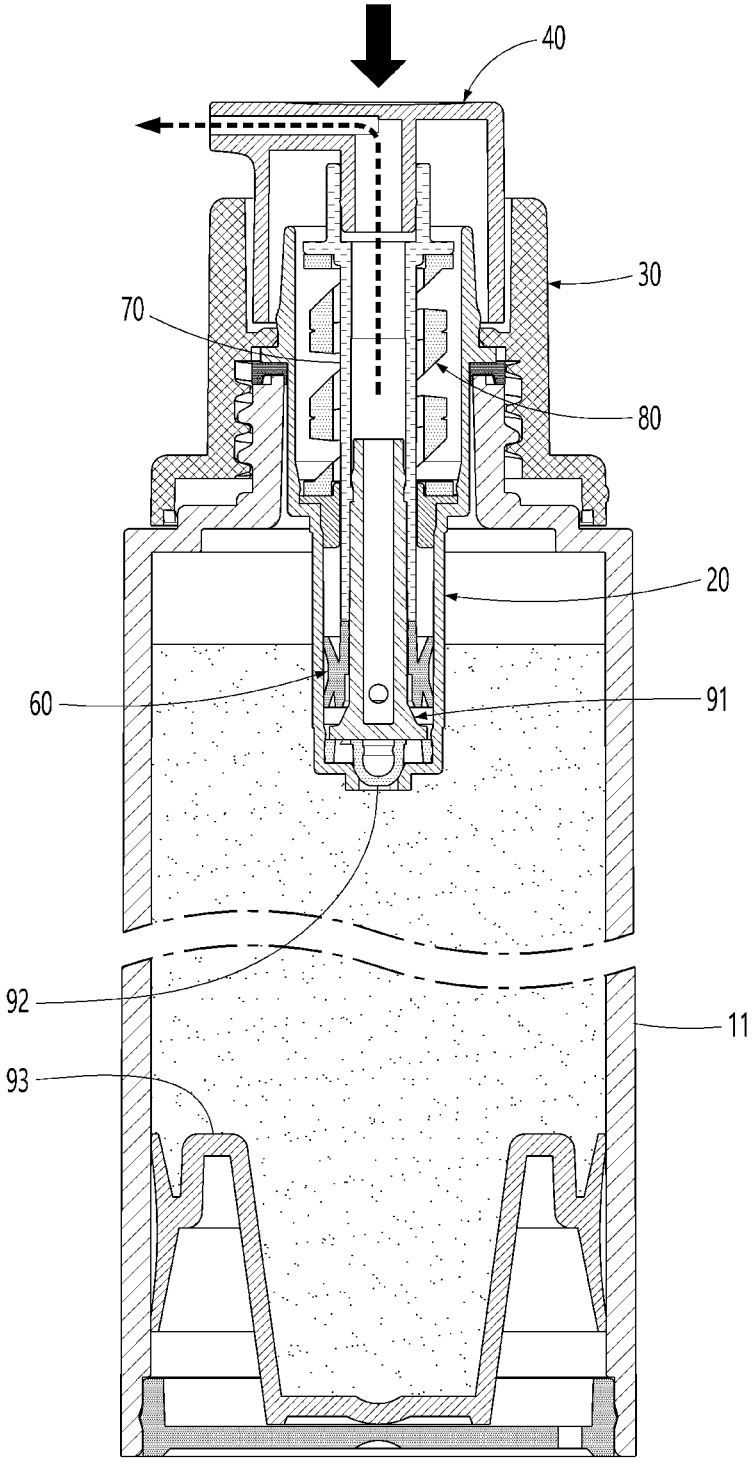
FIGS. 7 and 8 are views showing a method of using a cosmetic container according to an embodiment of the present disclosure, respectively.

Further, when the button 40 is descended, by the following operations, the liquid contents stored inside the cylinder 20 are discharged to the outside through the intermediate channel member 91, the pressing member 70, the vertical button channel part 43, and the horizontal button channel part 44 (see FIG. 7).

1) The intermediate channel member 91 starts to descend together with the button 40, and the cylinder piston 60 starts to descend later than the intermediate channel member 91.

2) As the cylinder piston 60 is descended later than the intermediate channel member 91, the portion between the intermediate channel opening/closing part 91*b* and the piston channel opening/closing part 62 is opened.

3) Also, as the cylinder piston 60 is descended, the inside of the cylinder 20 comes into a positive pressure state. The positive pressure state refers to a pressure state which is higher than atmospheric pressure.

4) When the inside of the cylinder 20 becomes a positive pressure state, the inlet hole 22*a* is closed by the cylinder valve 92.

When the operation of pressing the button 40 is stopped, the button 40 is ascended by the elastic force accumulated in the spring 80.

Figure 8:
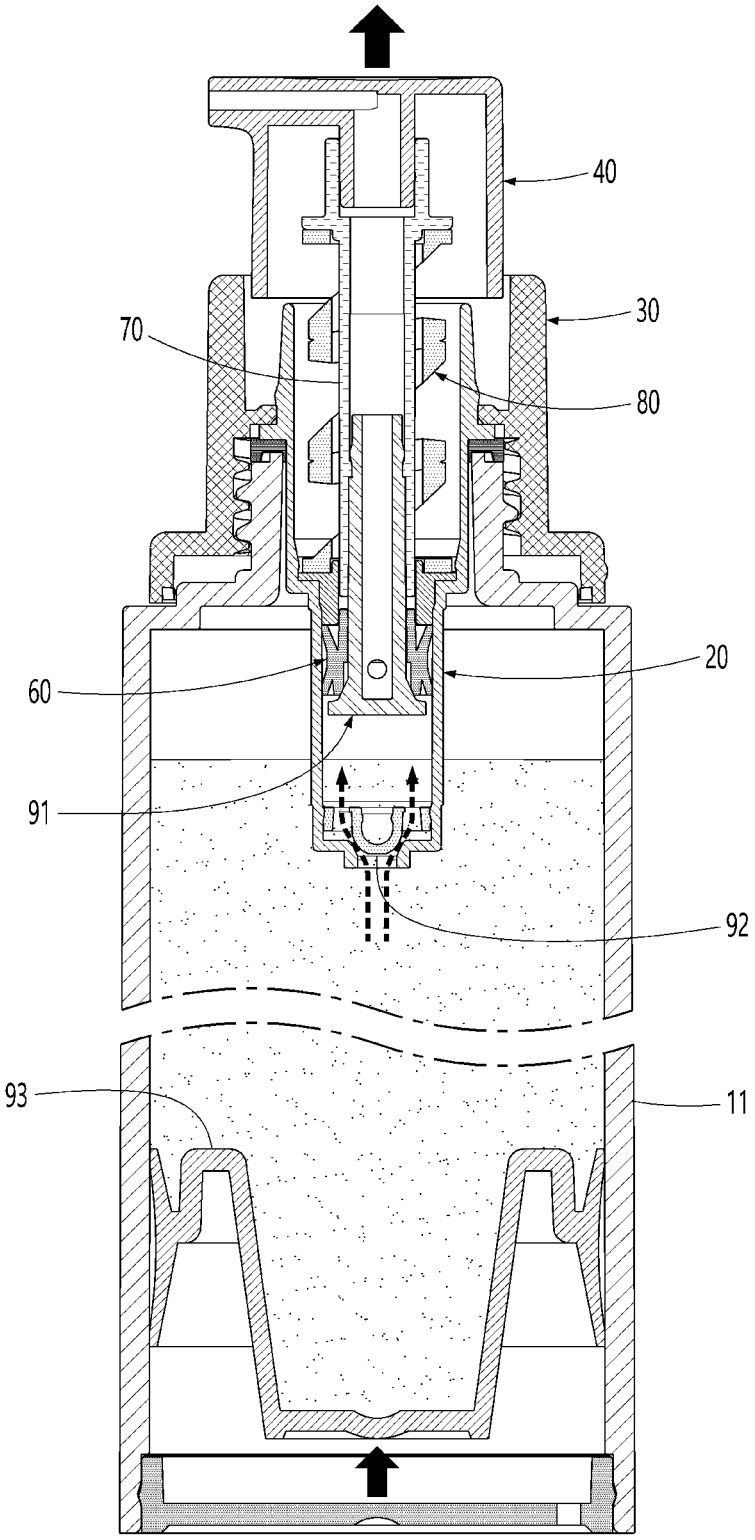

While button 40 ascends, the liquid contents stored in the container part 10 are introduced into the cylinder 20 through the inlet hole 22*a* by the following operations (see FIG. 8).

1) The intermediate channel member 91 starts to ascend together with the button 40, and the cylinder piston 60 starts to ascend later than the intermediate channel member 91.

2) As the cylinder piston 60 ascends later than the intermediate channel member 91, the portion between the intermediate channel opening/closing part 91*b* and the piston channel opening/closing part 62 is closed.

3) And then, as the cylinder piston 60 ascends, the inside of the cylinder 20 comes into a negative pressure state. The negative pressure state refers to a pressure state which is lower than atmospheric pressure.

4) When the inside of the cylinder 20 becomes a negative pressure state, the inlet hole 22*a* is opened by the cylinder valve 92.

Figure 9A:
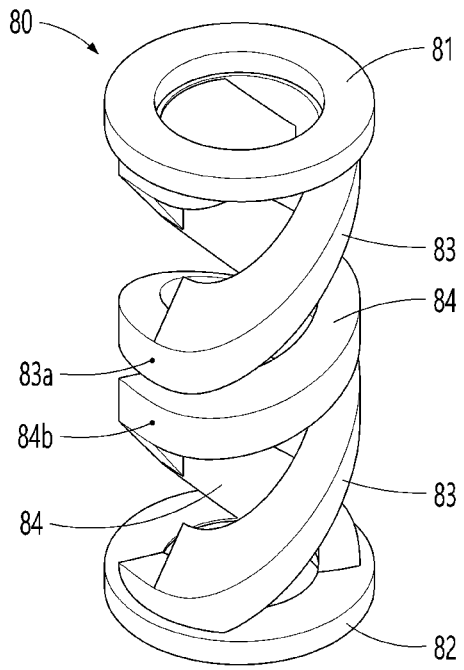
FIG. 9A and FIG. 9B are views showing a spring for a pumping-type container according to an embodiment of the present disclosure, respectively.
Figure 9B:
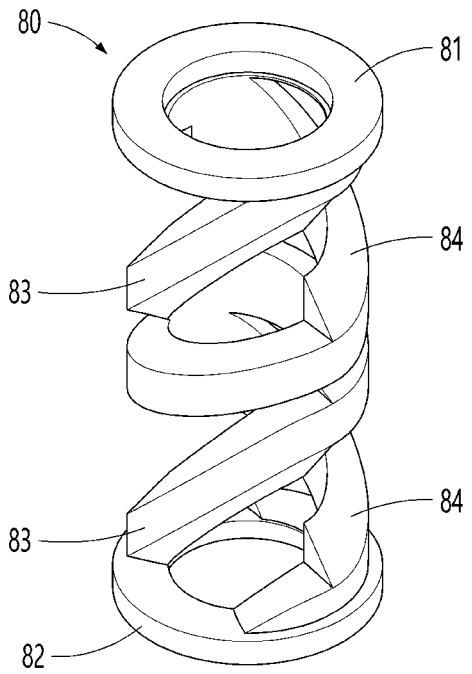
Figure 10:
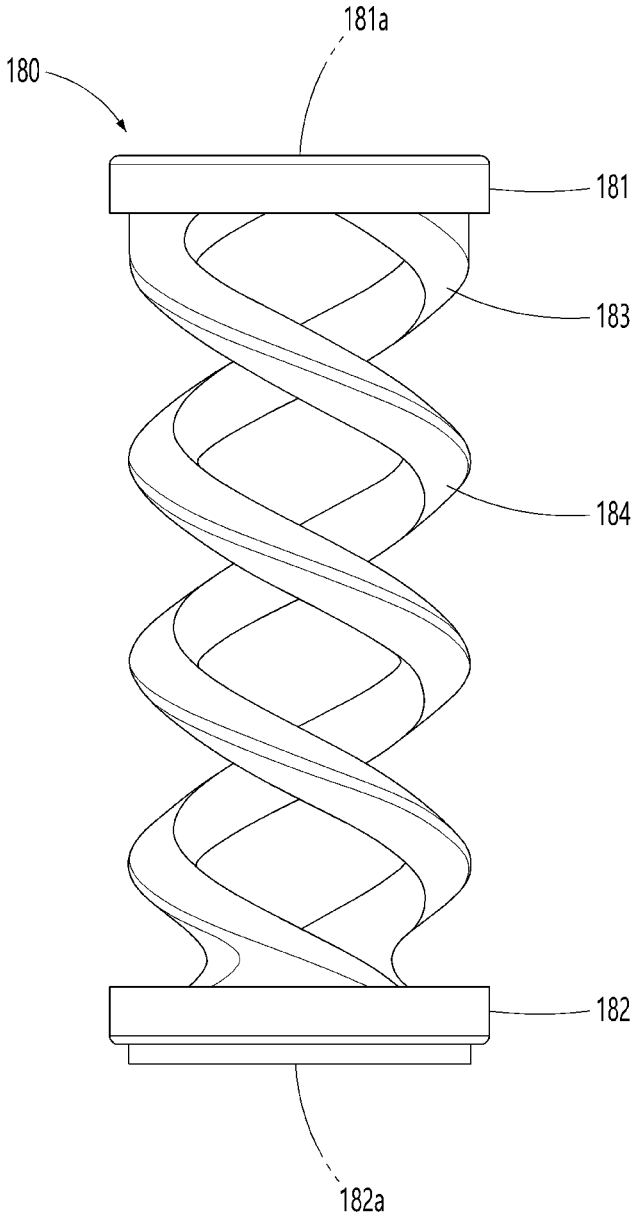
FIG. 10 PRIOR ART
FIG. 10 is a view showing a spring for a conventional pumping-type container.
Figure 11:
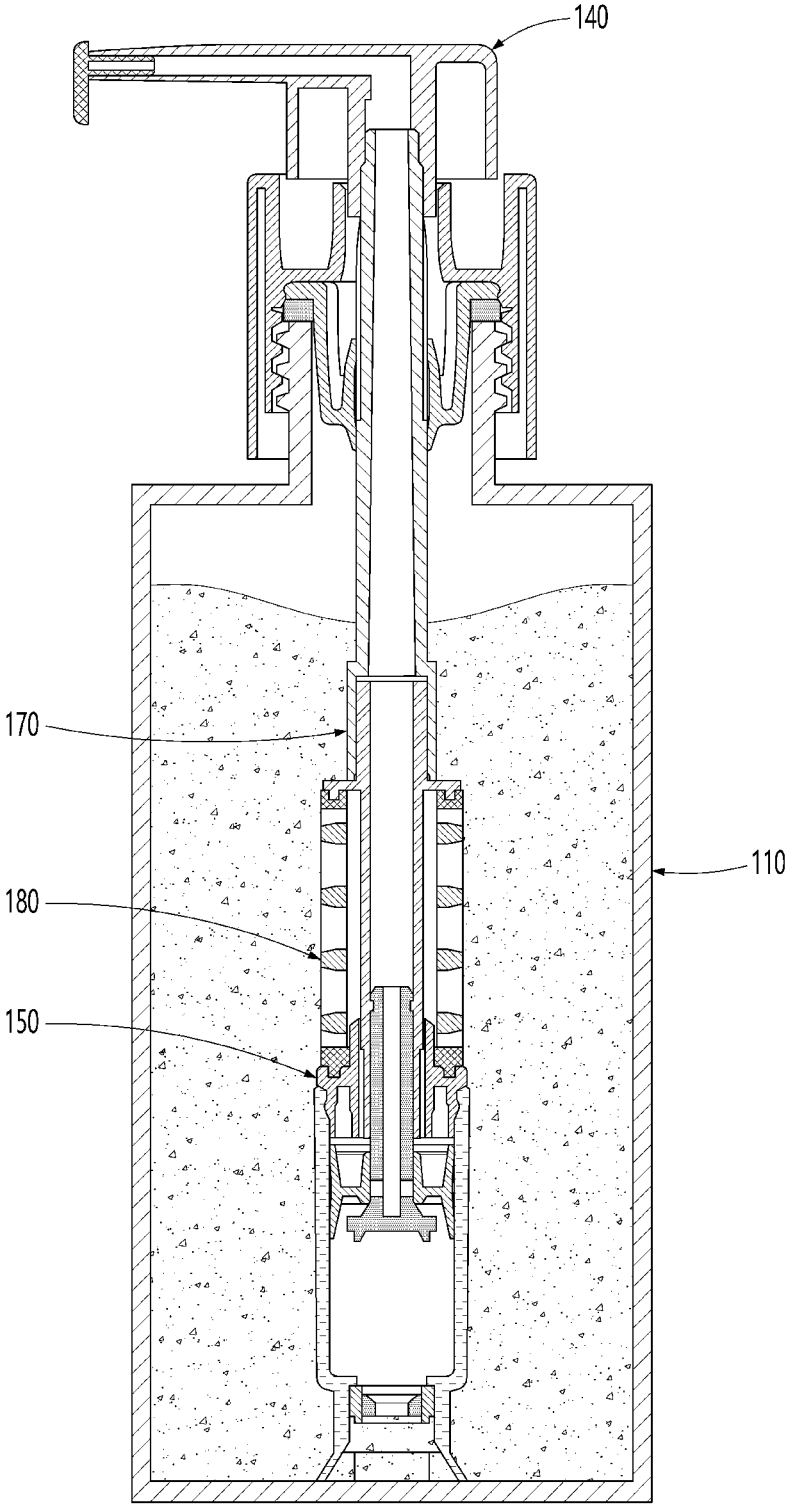
FIG. 11 PRIOR ART
FIG. 11 is a view showing a pumping-type container in which a conventional spring for a pumping-type container is installed.

In the above-described embodiment, the spring includes the first helical part 83 and the second helical part 84 each having a helical trajectory, the rotation angle of which is (180+360×N) degrees (N is 2). According to another embodiment, the spring includes a first helical part and a second helical part each having a helical trajectory, the rotation angle of which is (180+360×N) degrees (N is 1, see FIG. 9A and FIG. 9B) or (180+360×N) degrees (N is 3 or more).

Also, in the above-described embodiment, each of the first helical part 83 and the second helical part 84 has a left-hand helical shape. However, each of the first helical part and the second helical part has a right-hand helical shape (see FIG. 9A and FIG. 9B).

Further, the present disclosure may be configured to allow external air to flow into the container part through the upper portion of the container part.

What is claimed is:

1. A spring for a pumping-type container, the spring comprising:

an upper support plate having a circular upper through-hole extending therethrough;

a lower support plate which has a circular lower through-hole and is disposed below the upper support plate such that the lower through-hole is aligned with the upper through-hole;

a first helical part having a circular helical shape and installed between the upper support plate and the lower support plate such that the upper end thereof is fixed to the bottom surface of the upper support plate and the lower end thereof is fixed to the upper surface of the lower support plate; and a second helical part having a circular helical shape extending in a direction identical to that of the first helical part and installed between the upper support plate and the lower support plate such that the upper end thereof is fixed at a point of the bottom surface of the upper support plate, which is linearly symmetric to a point at which the upper end of the first helical part is fixed, with reference to the center line of the upper through-hole, and the lower end thereof is fixed at a point of the upper surface of the lower support plate, which is linearly symmetric to a point at which the lower end of the first helical part is fixed, with reference to the center line of the lower through-hole, wherein the first helical part has a helical trajectory, the rotation angle of which is (180+360×N) degrees (N is a positive integer), is connected to the upper surface of the second helical part through the bottom surface of a point at which a rotation angle of the helical trajectory from the upper end thereof is (360×M−180) degrees (M is a positive integer ≤N), is connected to the bottom surface of the second helical part through the upper surface of a point at which a rotation angle of the helical trajectory from the upper end is (360×M) degrees, and is configured such that a section descending from a first helical lower-surface connection point to a first helical upper-surface connection point has a lead angle smaller than that of the other portion of the first helical part, the first helical lower-surface connection point being a point connected to the upper surface of the second helical part through the bottom surface of the first helical part, and the first helical upper-surface connection point being a point connected to the bottom surface of the second helical part through the upper surface of the first helical part; and the second helical part has a helical trajectory, the rotation angle of which is (180+360×N) degrees, is connected to the upper surface of the first helical part through the bottom surface of a point at which a rotation angle of the helical trajectory from the upper end thereof is (360×M−180) degrees, is connected to the bottom surface of the first helical part through the upper surface of a point at which a rotation angle of the helical trajectory from the upper end is (360×M) degrees, and is configured such that a section descending from a second helical lower-surface connection point to a second helical upper-surface connection point has a lead angle smaller than that of the other portion of the second helical part, the second helical lower-surface connection point being a point connected to the upper surface of the first helical part through the bottom surface of the second helical part, and the second helical upper-surface connection point being a point connected to the bottom surface of the first helical part through the upper surface of the second helical part.

2. The spring of claim 1, wherein:

in the first helical part, a section descending from the upper end thereof to the first helical lower-surface connection point and a section descending from the first helical upper-surface connection point to the lower end thereof have cross-sectional areas larger than that of the section descending from the first helical lower-surface connection point to the first helical upper-surface connection point; and in the second helical part, a section descending from the upper end thereof to the second helical lower-surface connection point and a section descending from the second helical upper-surface connection point to the lower end thereof have cross-sectional areas larger than that of the section descending from the second helical lower-surface connection point to the second helical upper-surface connection point.

3. A pumping-type container comprising:

a container part in which liquid contents are stored;

a button installed above the container part; and a spring comprising an upper support plate having a circular upper through-hole extending therethrough, a lower support plate which has a circular lower through-hole and is disposed below the upper support plate such that the lower through-hole is aligned with the upper through-hole, a first helical part having a circular helical shape and installed between the upper support plate and the lower support plate such that the upper end thereof is fixed to the bottom surface of the upper support plate and the lower end thereof is fixed to the upper surface of the lower support plate, and a second helical part having a circular helical shape extending in a direction identical to that of the first helical part and installed between the upper support plate and the lower support plate such that the upper end thereof is fixed at a point of the bottom surface of the upper support plate, which is linearly symmetric to a point at which the upper end of the first helical part is fixed, with reference to the center line of the upper through-hole, and the lower end thereof is fixed at a point of the upper surface of the lower support plate, which is linearly symmetric to a point at which the lower end of the first helical part is fixed, with reference to the center line of the lower through-hole, wherein the first helical part has a helical trajectory, the rotation angle of which is (180+360×N) degrees (N is a positive integer), is connected to the upper surface of the second helical part through the bottom surface of a point at which a rotation angle of the helical trajectory from the upper end thereof is (360×M−180) degrees (M is a positive integer ≤N), is connected to the bottom surface of the second helical part through the upper surface of a point at which a rotation angle of the helical trajectory from the upper end is (360×M) degrees, and is configured such that a section descending from a first helical lower-surface connection point to a first helical upper-surface connection point has a lead angle smaller than that of the other portion of the first helical part, the first helical lower-surface connection point being a point connected to the upper surface of the second helical part through the bottom surface of the first helical part, and the first helical upper-surface connection point being a point connected to the bottom surface of the second helical part through the upper surface of the first helical part; and the second helical part has a helical trajectory, the rotation angle of which is (180+360×N) degrees, is connected to the upper surface of the first helical part through the bottom surface of a point at which a rotation angle of the helical trajectory from the upper end thereof is (360×M−180) degrees, is connected to the bottom surface of the first helical part through the upper surface of a point at which a rotation angle of the helical trajectory from the upper end is (360×M) degrees, and is configured such that a section descending from a second helical lower-surface connection point to a second helical upper-surface connection point has a lead angle smaller than that of the other portion of the second helical part, the second helical lower-surface connection point being a point connected to the upper surface of the first helical part through the bottom surface of the second helical part, and the second helical upper-surface connection point being a point connected to the bottom surface of the first helical part through the upper surface of the second helical part.

4. The pumping-type container of claim 3, wherein:

in the first helical part, a section descending from the upper end thereof to the first helical lower-surface connection point and a section descending from the first helical upper-surface connection point to the lower end thereof have cross-sectional areas larger than that of the section descending from the first helical lower-surface connection point to the first helical upper-surface connection point; and in the second helical part, a section descending from the upper end thereof to the second helical lower-surface connection point and a section descending from the second helical upper-surface connection point to the lower end thereof have cross-sectional areas larger than that of the section descending from the second helical lower-surface connection point to the second helical upper-surface connection point.

* * * * *